US006613144B1

(12) United States Patent
Loertscher et al.

(10) Patent No.: US 6,613,144 B1
(45) Date of Patent: Sep. 2, 2003

(54) PUMP-FREE DOSING DEVICE FOR FLOWABLE MEDIA

(75) Inventors: Ulrich Loertscher, Zurich (CH); Toni Pfluger, Erlenbach (CH)

(73) Assignee: Kuyus-Stiftung (LI)

( * ) Notice: Subject to any disclaimer, the term of this patent is extended or adjusted under 35 U.S.C. 154(b) by 0 days.

(21) Appl. No.: 09/673,751

(22) PCT Filed: Apr. 22, 1999

(86) PCT No.: PCT/CH99/00164

§ 371 (c)(1),
(2), (4) Date: Feb. 8, 2001

(87) PCT Pub. No.: WO99/53815

PCT Pub. Date: Oct. 28, 1999

(30) Foreign Application Priority Data

Apr. 22, 1998 (CH) ..... 919/98

(51) Int. Cl.[7] ..... B05C 5/00

(52) U.S. Cl. ..... 118/302; 118/325; 427/8; 427/209; 222/491

(58) Field of Search ..... 118/302, 325, 118/37, 420, 504, 506, 203; 222/490, 491; 427/209, 420, 421, 355, 8

(56) References Cited

U.S. PATENT DOCUMENTS 3,652,174 A * 3/1972 Bonne ..... 118/325
5,672,206 A 9/1997 Gorman

FOREIGN PATENT DOCUMENTS

| | | |
|---|---|---|
| DE | 35 35 330.9 A1 | 4/1987 |
| DE | 36 01 591.1-16 C1 | 7/1987 |
| DE | 298 09 967 U1 | 12/1998 |
| EP | 0 624 337 A1 | 11/1994 |
| WO | WO 92/19141 | 11/1992 |
| WO | WO 93/04622 | 3/1993 |
| WO | WO 93/22961 | 11/1993 |
| WO | WO 98/04177 | 2/1998 |

* cited by examiner

*Primary Examiner*—Richard Crispino
*Assistant Examiner*—Y. T. Tadesse
(74) *Attorney, Agent, or Firm*—Rothwell, Figg, Ernest & Manbeck, P.C.

(57) ABSTRACT

The invention relates to a device for dosing flowable, preferably thick media, without the use of a pump. The device can preferably be interchanged on the cover or can be fixed as a cover of a common withdrawing device for paper towels, woven fabrics or other fabrics, cotton balls and the like. The inventive device comprises a dispensing container which is either constructed as a cover itself or comprises means for fastening on such a cover. In addition, said container releases a desired quantity of medium located therein when pressure is exerted on a predetermined partial area. The invention is preferably used in the areas of personal hygiene, household cleaning and industry in order to clean, polish and/or lubricate.

26 Claims, 4 Drawing Sheets

PUMP-FREE DOSING DEVICE FOR FLOWABLE MEDIA

Figure 1:
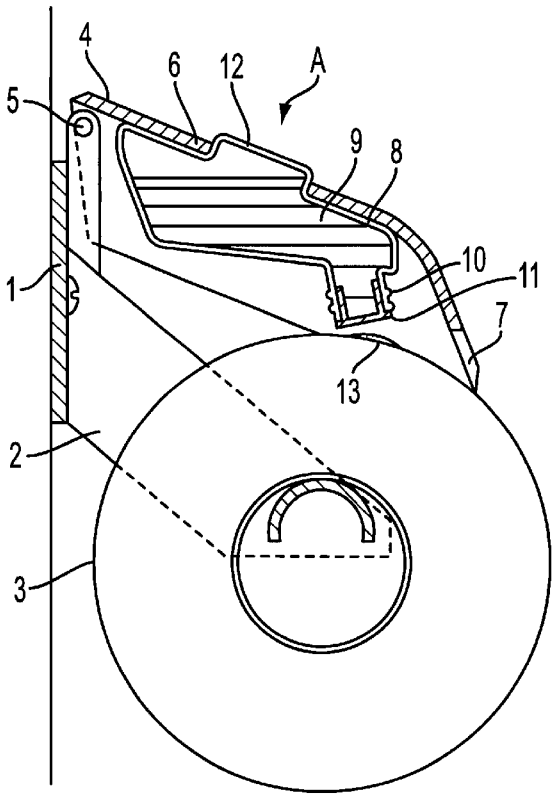

The present invention refers to a pump-free dosing device for the application of a cleaning and/or care emulsion to paper, hygienic towels, cotton balls or pads and the like for personal hygiene, body therapy or domestic hygiene.

The cleaning action of ordinary dry paper is not at all times satisfactory. The manifold need for better and additional cleaning is often met by the known moistened cleaning towels.

This type of additional cleaning, however, has diverse disadvantages. The manipulation involving a closed container is mostly somewhat cumbersome. Moreover, the moistened towels are relatively expensive and rapidly dry up. In addition, nonwoven cellulose fabric towels often contain preservatives from nonwoven fabric production which may provoke allergies, particularly in tender baby skin. Besides, the nonwoven fabric towels may clog the sewers and in most cases are hard to decompose. Also, the fragrant substances contained in the ready-wipe towels may provoke allergies, and substances that compromise the protective functions of the skin are utilized to prevent drying.

Devices have already been proposed which dispense moistened cleaning towels in toilets on demand. Thus, WO 93/04622 describes a spray device that moistens the paper before it is withdrawn. This device is mounted above the roll of paper and is actuated by a lever functionally connected with a metering pump. A technically demanding dispenser for cleaning towels is described in WO 98/04177, where the paper is advanced by motor-driven rollers and the liquid is applied by a pump-driven spray nozzle head actuated by a motor-driven eccentric. In WO 93/22961 a moistening device fixed outside the roll case is proposed where the paper is first withdrawn, then the moistening occurs by lifting of a simple valve at the withdrawal unit. These devices require either a pump or a valve for moistening of the paper, and the liquid is applied by spraying.

It is the aim of the present invention, to the contrary, to directly equip a withdrawal device for hygienic towels, cotton balls and the like, essentially of the usual design, with an additional simple, pumpless dosing or metering device providing a better possibility for cleaning and/or care, and applicable in particular for viscous emulsions.

Withdrawal devices envisaged in this sense are primarily toilet paper holders. Beyond that this term also encompasses holders for other wiping aids such as rolls of kitchen towels or other cleaning and/or care towels or papers in the form of rolls, boxes for piles of paper or fabric towels that could be doubled or folded, boxes or cups for cotton balls or cotton pads, as well as other supply containers of the same or similar kind for the withdrawal of wiping aids appropriate for the application of flowable, and more particularly non-sprayable media to surfaces. Preferred media are creamlike emulsions or gels, particularly those for body care, personal hygiene and/or body therapy.

In other applications such as cleaning, polishing and/or lubricating of the surfaces of objects of all kinds, particularly those with preferably smooth metal, plastic, wood or glass surfaces, different media, always flowable and preferably viscous, which are available, either directly as the corresponding cleaners, polishes and/or lubricants or at least contain these agents, are utilized as the application may demand.

The withdrawal device preferably comprises a cover that can be raised or detached, or a lid of the same kind, or can be fitted with such a cover or lid. In addition the withdrawal device is preferably suitable for wall mounting, but within the scope of the present invention this term shall also be understood as including floor models and transportable models of paper holders, boxes and other of the above-mentioned supply containers.

According to the invention, this aim is achieved by mounting at the cover of such a withdrawal device, a dispensing container so built and oriented that by pressing or squeezing of the dispensing container or of a region thereof, a medium, preferably viscous, for instance a cleaning and/or care emulsion, can be applied to the paper, the hygienic towels, cotton balls, cotton pas and the like.

Features of the invention that should be mentioned as advantages, apart from its simple operation, are particularly the following: withdrawal devices of traditional design can be used; the dispensing container either constitutes itself the cover or is directly mounted at the cover of the withdrawal device; it proves to be a significant advantage in the latter case, moreover, that the dispensing container when mounted beneath the cover is practically invisible in its service condition, apart of course from that region designated for triggering a dosage by pressing; the dispensing container preferably can be exchanged and, when this is done, is readily mounted to and detached from the cover; it can be manufactured at an advantageous price. By simply pressing on a region of the dispensing container, for instance a cleaning cream or care cream for different needs such as deodorizing, cooling, against burning, itching etc., but also for therapeutic treatments of hemorrhoids, fistulas or anal fissures for instance can be dispensed onto a desired sheet of paper or hygienic towel or a cotton ball or pad. Particularly in the case of paper of inferior quality such as toilet paper made of recycled paper, the cream will prevent irritations of the skin in the anal region caused by contact allergens contained in the paper. Moreover, the targeted, spotlike application of a liquid or cream to a wiping aid such as a sheet of paper is more economic than a wide-area distribution thereon, and in the instance of paper has in addition a softening effect. Also, the disposal problems known from the use of fabric towels such as nonwoven fabric towels do not arise when using the dosage device according to the invention in combination with paper towels.

The withdrawal device as a rule is a paper roll holder of common design such as the ones known for toilet paper or paper towels. However, it is also possible to arrange the paper supply as a pile, particularly of individual sheets, or folded, doubled and perforated. Moreover, apart from paper, other materials suitable for the uptake of cream such as cotton or textile fabrics can be envisaged.

Dosage device for dispensing the emulsion is a dispensing container which at least in the region intended for pressure application is made of material that is elastic to compression or bending or can be creased. The dispensing container can be mounted beneath or above the cover for the paper, the fabric towels or the cotton pads. In another embodiment, the dispensing container itself is formed as the cover and mounted directly on the wall bracket of the withdrawal device, for instance via a hinge. In the case of boxes for piles of papers or cotton pads, this fixation usually occurs at the upper edge of the back wall.

The dispensing container can basically be fixed in a permanent way at the withdrawal device, and the cleaning an/or care product can be refurnished through a sealable opening, but it is preferred to mount the container so that it can be exchanged. Mounting and demounting can be performed without tools in the latter case. This is possible, for instance, by clamping or engaging of the dispensing container in the cover. To this end a recess is provided in the cover in a preferred embodiment, and a corresponding bulge of the dispensing container is passed through this recess. Preferably, the bulge has a shape complementary to that of the recess. The shape of the recess is in no way limited, preferred shapes are circular or ellipsoidal. Instead of a recess, at least one cavity can be provided at the front or side of the cover into which the dispensing container, correspondingly shaped, can be pushed, while the bulge of the container is clamped between the edges of the cavity. Here the cavity is preferably shaped so that the entrance opening for insertion of the dispensing container has a smaller diameter than the bulge of the dispensing container, while the adjoining section of the cavity corresponds to the diameter of the bulge at the dispensing container, so that after passing the entrance opening the bulge will engage into a stable position within the cavity where it will not slip.

At least some section at the neck of the bulge has a somewhat larger cross section than the recess or cavity of the cover so that the bulge of the dispensing container can be clamped into the recess. In this case at least this region of the bulge consists of material that can be creased, so that the bulge is readily deformed and thus can be pushed into the recess. Then the bulge is reestablished by pressure balance, while the neck of the bulge adheres to the inner edge of the recess and the upper edge of the bulge adheres to the cover while projecting over the edge of the recess, or overlapping the recess, so that the container is fastened to the cover without the possibility to slip. The neck of the bulge can for instance be cylindrical and have an edge projecting beyond the edge of the recess. In a preferred embodiment the neck of the bulge is concave while the edge of the recess at the cover is of convex shape.

In this way the container can be mounted in a sufficiently stable fashion both beneath and above the cover. The container can be taken off by exerting a pull on the container in a direction opposite to that of its insertion, whereupon the bulge contracts and thus can be pulled from the recess.

Another possibility for mounting is that of clamping the dispensing container at the cover or at lateral flaps that might be present. To this end, projections or other convexities or, to the contrary, concavities or openings are provided on the inner walls of the lateral flaps. For this kind of mounting the container has essentially complementary concavities and convexities, and is pushed from below against the cover and/or lateral flaps, whereupon it engages into these projections or concavities. The projections can furthermore be shaped as guide rails, in which case the dispensing container is then inserted under the cover from the front side. To this end guide notches or grooves can be provided at the container. The cover can likewise comprise convexities, and via the corresponding projections or guide rails at the container the latter is inserted or pushed into the cover.

For an additional protection from below, at least one fixing strap can be mounted so as to support the dispensing container. This strap can for instance be mounted with a hinge at a lateral flap, and inserted into a hook at the opposite lateral flap so as to support the bottom of the dispensing container.

Of course, another device providing support from below, such as taut, elastic strips, for instance rubber bands, can be mounted. Such a device can also be fixed at the back and front side of the cover, rather than at the lateral flaps. Moreover, embodiments of the invention are possible where the dispensing container is held exclusively by such straps and/or other systems of fixation, without being clamped into a recess or between the lateral flaps, For instance, grip or glue fixations such as adhesive tape and also magnetic fixations can be used alone or in combination with other systems of fixation in order to fasten the dispensing container at the upper or lower side of the cover or secure it additionally. To this end the dispensing container on one hand and the cover and/or wall bracket of the withdrawal device on the other hand are provided with corresponding complementary parts of the elements of fixation mentioned.

In addition to, or instead of, a clamping-type fixation the dispensing container can be fastened at the cover by a screw or bayonet union. To this end the bulge of the container for instance can be inserted through the recess in the cover, and secured by a fixation, preferably a screw or bayonet union, on the opposite side of the cover. The locking cap may for instance comprise a membrane that is elastic to compression. Another possible fixation of the container is that of screwing the dispensing container into the recess of the cover via a thread in the bulge of the dispensing container. In the last-mentioned embodiment, a counterthread can be provided if appropriate at the inner edge of the cover's recess.

The possibilities of fixing the dispensing container at the wall bracket or cover of the withdrawal device which have here been cited as examples do not constitute the final selection, and are not meant to limit in any way the present invention. It is essential for the present invention that the dispensing container is mounted directly at the cover or lid of the withdrawal device, or where appropriate constitutes itself this cover or lid.

In view of its preferred ease of exchange, the dispensing container is particularly well suited to be a disposable container. However, in some embodiments a possibility for refills of the dispensing container exists, optionally while mounted at the cover or while detached, for instance by using premanufactured refill packs.

The delivery of the cleaning and care emulsion occurs upon direct finger pressure on an elastically deformable or creasable region of the dispensing container provided to this end. When mounted beneath the cover of the withdrawal . . . [text missing. Translator], the surface of the bulge projecting through the cover. When mounted above the cover, either the entire dispensing container or only the upper side that is accessible from above, or merely part of this upper side is made of elastically deformable or creasable material. Here the quantity of cleaning and/or care emulsion delivered is proportional to the pressure exerted, and thus dosable.

Instead of direct finger pressure, the container can also be pressed via a lever. Such lever action can be triggered manually or electrically, and the electric triggering can occur without contact via an optical or thermal sensor.

For the independent delivery of two or more different emulsions, either dispensing containers having several chambers each comprising a region that is at least partly deformable, or if appropriate at least two dispensing containers can be provided at the cover.

The at least one delivery opening of the dispensing container is situated at the lowest point of the container when the cover is shut, and is preferably neck-shaped to allow full utilization of the cleaning and care emulsion. A locking thread can be arranged at the neck of each delivery opening. An inset with corresponding dosing hole is preferably situated in the delivery opening. The dosing hole can have different diameters. This allows an additional adjustment of the dosage and primarily makes sense, either when the dispensing container is used for emulsions having different consistencies, or when the dispensing container is used under different climatic conditions, since the viscosities of the care and/or cleaning emulsions as a rule decrease with increasing temperature.

The dosing inset can be provided with a pyramidal extension having at least two steps, if it is envisaged to adjust the dosing hole in steps. The smallest diameter is then found in the outermost stage, and the largest diameter in the innermost stage. The dosing hole with the desired diameter is obtained by cutting off the inset at the appropriate step. A infinite adjustment of the dosing hole can be obtained, for instance, when using an extension in the form of a hollow cone having an inside diameter becoming narrower toward the outside. This will again be cut off at the position where the desired diameter of the dosing hole is found. Of course, the extensions can be pre-perforated at the appropriate positions, and other means for adjusting the dosing holes, such as setscrews, can be used.

The dosing or metering device according to the invention can be utilized for any kind of flowable, though preferably viscous, non-sprayable media. Preferred are emulsions having the consistency of creams, oils or gels. For body care and/or domestic hygiene applications, creams are preferred which will not grease, stick, or form spots. An appropriate cavity can be provided at the front end of the cover—in case the cover is in direct contact with the paper roll or pile of paper towels or hygienic towels—in order to avoid unnecessary smear of the cream or gel while pulling the paper or hygienic napkin from the withdrawal device. Emulsions suitable for being used with the dosing device according to the invention preferably have a consistency of 8000 to 45000 cps. A particularly preferred emulsion for body care and body therapy has a consistency between 31000 cps at 0° C. and 9000 cps at 40 C., while its consistency at room temperature of 21° C. is about 11000 cps. Among other constituents, such emulsions contain the usual constituents of cosmetic creams or gels such as vegetable fats and oils, for instance coconut fats and oils, the esters of fatty acids and fatty alcohols, sorbitol, glycerol, vegetable extracts and essential oils, for instance of camomile or hamamelis, etc.

Depending on the intended application, the cleaning and/or care emulsion can contain the most diverse additives such as disinfectants, deodorants, care substances, and skin-specific cosmetic agents. For deodorant or scent effects, for instance, perfume compositions identical to nature and/or essential oils are used.

For the purposes of a specific care and prophylaxis in skin cleaning and skin care, particularly in the genital regions or in wound protection, vegetable essences of herbs, for instance camomile, marigold, hamamelis, or wheat germs can be added.

The device according to the invention is preferably used in sanitary zones. The creams can for instance be used to moisten toilet paper, and apart from cleaning provide an additional curative effect by alleviating itching and burning or skin reddening. Apart from that, a therapeutic use for the treatment of hemorrhoids, anal fissures and the like is also advantageous. The care of sensitive baby skin, particularly in the anal and genital region, is also facilitated and improved owing to the present invention. Cosmetics or emulsions serving for skin care, wound protection or wound dressing can also be dispensed, since the use of the device is not at all restricted to anal and/or genital hygiene. Beyond that the invention is particularly suited for the dosing of flowable media used in industry or households, for instance in the form of cleaning, polishing and/or lubricating agents. By way of example only, applications in the vehicle, furniture or glass sector are pointed out.

By means of the appended drawings, the present invention is explained in greater detail in the instance of five preferred embodiments.

Shown are

Figure 2:
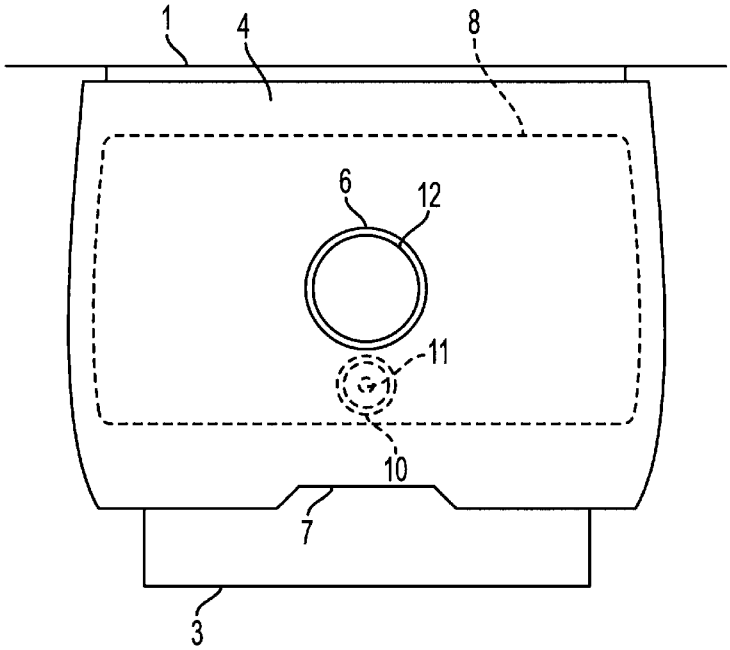
Figure 3:
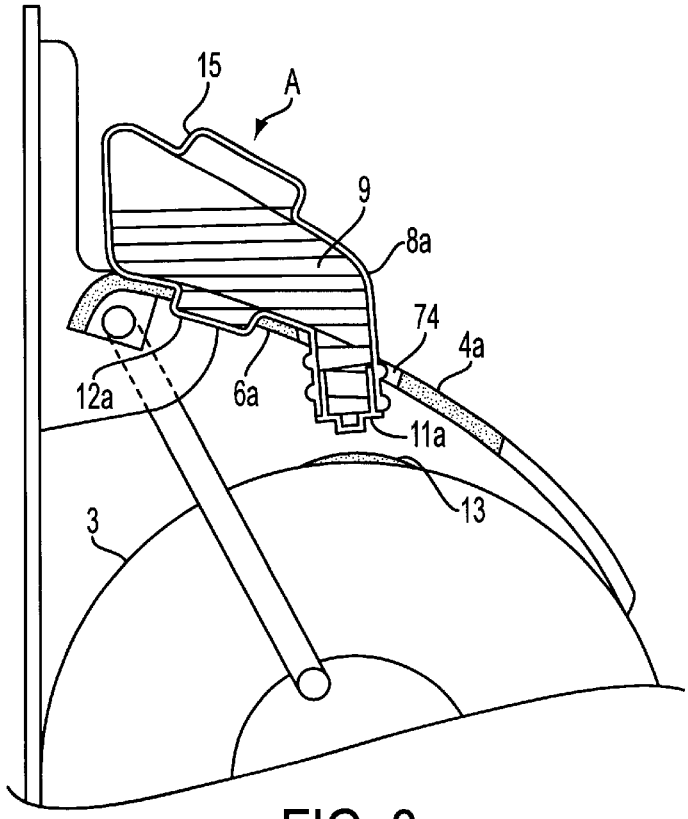
Figure 4:
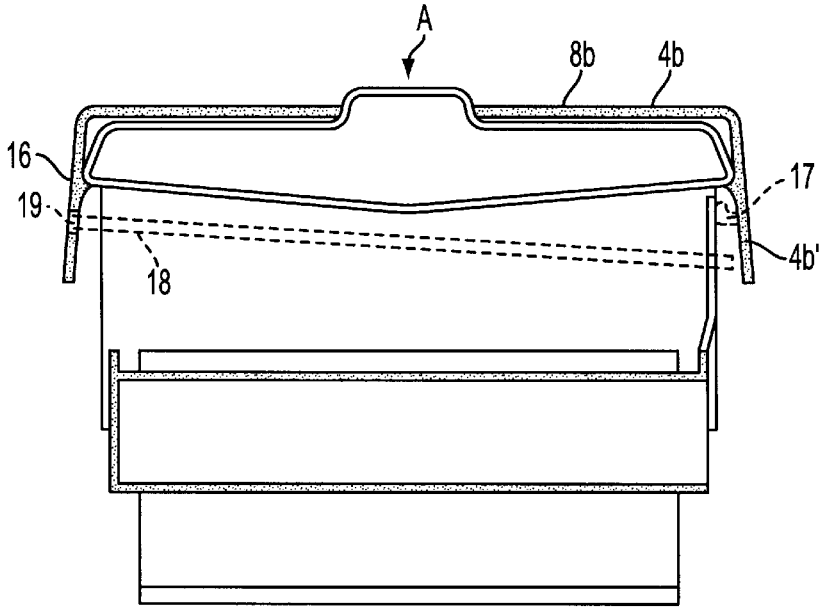
Figure 5:
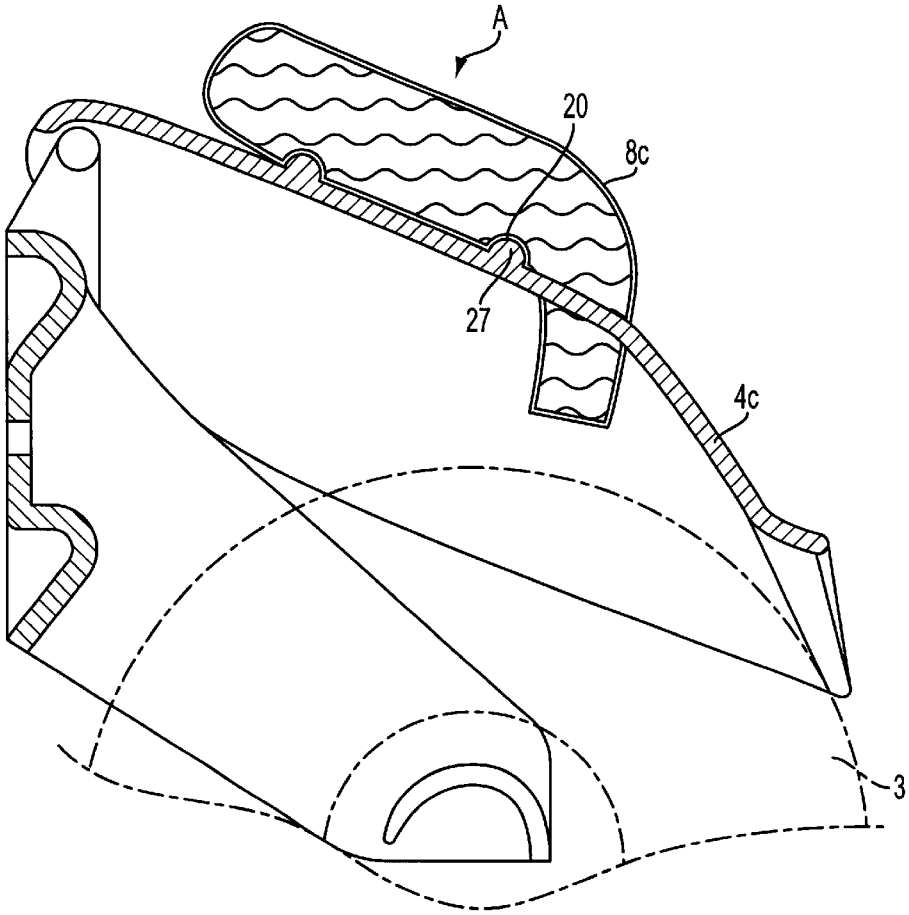
Figure 6:
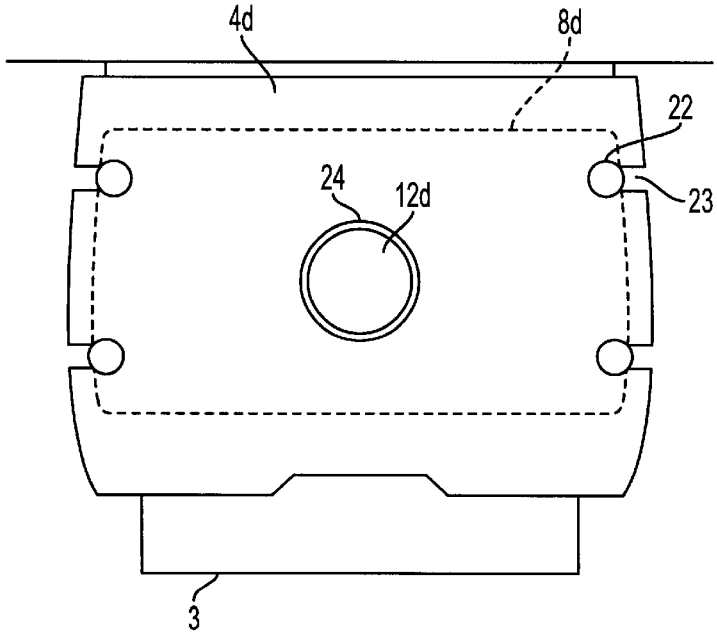
Figure 7:
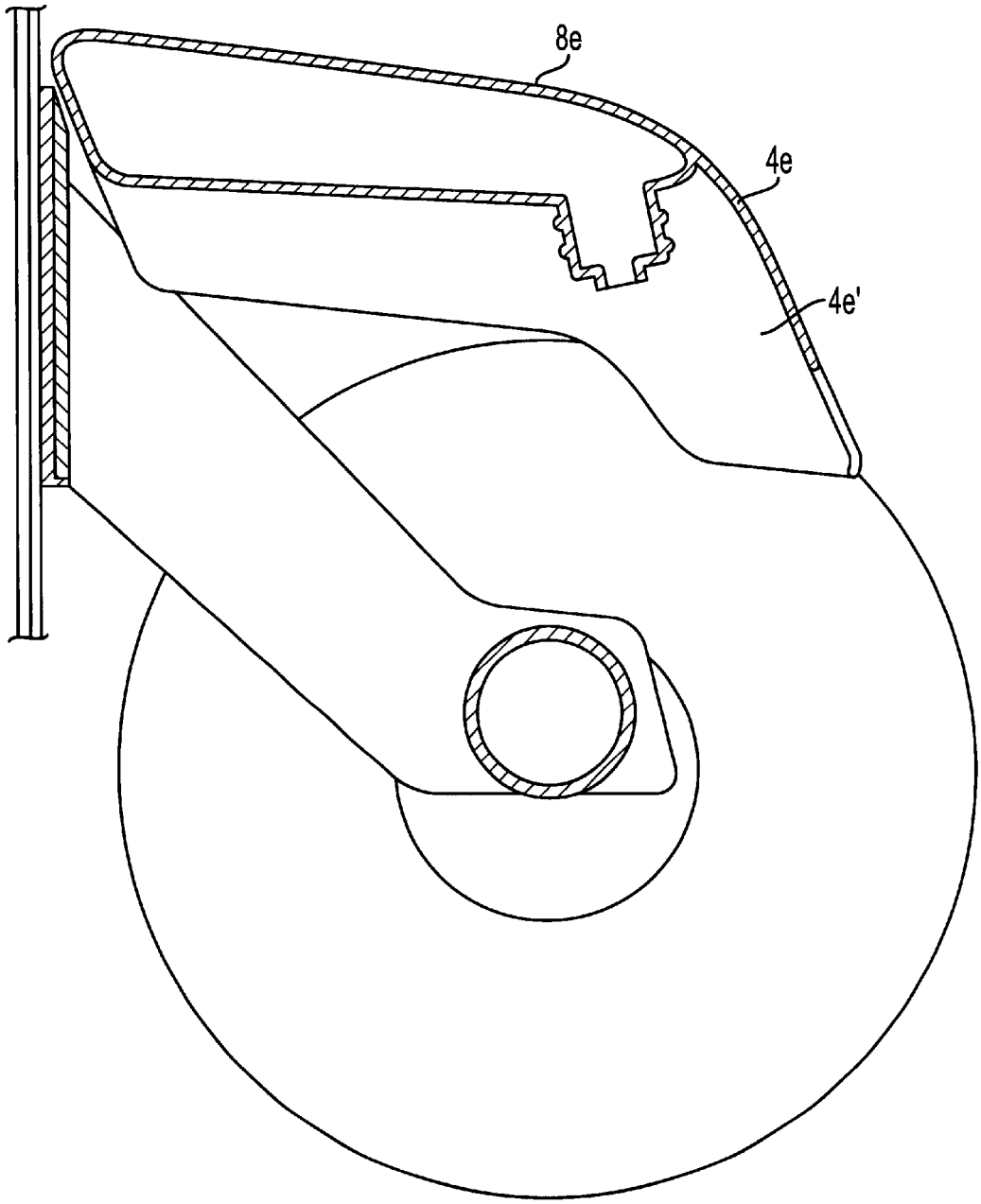

- in FIG. 1 a sectional view of a dosing device with dispensing container mounted beneath the cover of a toilet paper roll,
- in FIG. 2 this dosing device from above,
- in FIG. 3 a sectional view of a dispensing container mounted above the cover,
- in FIG. 4 a sectional front view of a dispensing container that is clamped between the lateral flaps of the cover,
- in FIG. 5 a sectional view of two recesses in a dispensing container mounted above the cover,
- in FIG. 6 a top view of a dosing device mounted beneath the cover by engaging into lateral recesses, and
- in FIG. 7 an embodiment where the dispensing container itself constitutes the cover.

FIG. 1 shows a sectional view of a preferred embodiment of the dosing device. A roll holder 2 receiving a paper roll 3 is mounted on the wall bracket 1. This arrangement is known and common. In this embodiment, an opening 6 is provided at the cover 4 for a container bulge 12, and a cavity 7 is provided on the front side as passage for the emulsion or cream dosage 13. A dispensing container 8 serving as supply for a cleaning and care emulsion or cream 9 is mounted beneath the cover 4. The dispensing container 8 is so designed that the container neck 10 with locking thread is in a position narrowly above the paper roll 3, preferably centered in the middle. An inset 11 with appropriate dosing hole is located within the container neck 10. A desired dosage 13 is supplied when pressing in the direction of A on the surface of container bulge 12 which is elastic to compression.

FIG. 2 shows the holder and dispensing container from above. The wall bracket 1, the paper roll 3, the cover 4, the hole 6, the cavity 7 and the container bulge 12 can be seen diagrammatically. Hidden and represented in dashed lines one recognizes the dispensing container 8, the container neck 10 and the inset with dosing hole 11.

FIG. 3 shows a sectional view of a dosing device where the dispensing container is mounted above the cover. This embodiment is distinguished by a particularly simple possibility for exchange of the dispensing container. Similar to FIG. 1, the dispensing container 8*a* with container bulge 12*a* is clamped by insertion into the recess 6*a* of cover 4*a*. In this embodiment a further recess 14 is provided which serves as a passage for the container neck with dosing hole 11*a*. It could also be visualized, of course, to mount a dispensing container above a cover with just one recess, in which case a container bulge 12*a*' would be integrated into the container neck above the dosing hole. A further bulge 15 can be provided in addition on the upper side of the dispensing container. It is also possible, however, to have the entire surface of the dispensing container or some part of it made of a material elastic to compression or bending, in which case a specific bulge for proper manipulation will not be required.

Applying pressure with a finger in the direction of compression A, any given amount 13 of cleaning or care emulsion 9 is delivered to the paper 3.

FIG. 4 shows a sectional front view of a dispensing container 8*b* engaged between the lateral flaps 4*b*' of the cover 4*b*. The container 8*b* was pushed from below into this holder, and is retained by the two projections 16. The projections can also be in the shape of guide rails, in which case the container will be inserted from the front side. The container can have guide notches or guide grooves. The bulge of the dispensing container will then either be pushed through beneath the cover until reaching the recess of the cover, or the bulge is pushed into a lateral cavity or cavity open toward the front side of the cover. It is advantageous to mount at least one strap 18—indicated in dashed lines—beneath the container so as to provide additional protection; this can for instance be attached to the hook 17 and fixed to a hinge 19.

FIG. 5 shows a sectional view through two recesses in a container mounted above the cover. The container 8*c* is mounted at the cover 4*c* by connecting the knubs 21 of cover 4*c* with the recesses 20 of container 8*c*. For this kind of fixation at least one knub is required. The bulges at the cover or recesses in the container can once more be of the most diverse shape, for instance rails, grooves or notches. The cover can be in the form of straps each provided with its fastening device, while the space between straps is bridged by the dispensing container. Instead of clamp-type fastening, the container can be suspended in the straps, with a hook for instance.

FIG. 6 shows a top view of a dosing device mounted beneath the cover by engaging into lateral recesses. In this embodiment the dispensing container 8*d* has retaining elements 22 through which the dispensing container engages into the lateral cavities 23 at the cover 4*d*—in this embodiment without lateral flaps—of the paper 3. In addition a recess 24 is provided at cover 4*d* through which a container bulge 12*d* with the actuating area for emulsion dosage is projecting.

FIG. 7 shows a further embodiment of the dosing device where the dispensing container 8*e* is fashioned as the cover 4*e* of the paper. In practice a wedge-shaped dispensing container 8*e*, if appropriate with lateral walls 4*e*', will be preferred.

What is claimed is:

1. A device for dosing of a flowable, medium without the use of a pump, characterized in that the device can be fastened at a withdrawal device for wiping aids and contains a dispensing container (8, 8*a*, 8*b*, 8*c*, 8*d*, 8*e*) which either is itself formed as a cover (4*e*) for the wiping aids or contains means for fixation at the cover (4, 4*a*, 4*b*, 4*c*, 4*d*).

2. The dosing device according to claim 1, characterized in that the device comprises at least one neck-shaped delivery opening (11, 11*a*) positioned in a mounted and operable condition at a lowest point of the dispensing container (8, 8*a*, 8*b*, 8*c*, 8*d*), and that the dispensing container at an upper side in the mounted and operable condition has at least one zone consisting of material elastic to compression or bending, or creasable where by exertion of pressure on this zone a desired quantity of the medium (9) contained in the dispensing container (8, 8*a*, 8*b*, 8*c*, 8*d*) can be dosed.

3. The dosing device according to claim 2, characterized in that the at least one delivery hole is fitted with means for adjusting a diameter of the hole.

4. The dosing device according to claim 1, characterized in that the dispensing container (8, 8*b*, 8*d*) is shaped for mounting at a lower surface of the cover (4, 4*b*, 4*d*) and provided with fastening means for rapid mounting and demounting.

5. The dosing device according to claim 4, characterized in that the dispensing container (8, 8*b*, 8*d*) has for mounting beneath the cover (4, 4*b*, 4*d*) a fastening strap (18) which runs along a bottom surface of the dispensing container (8, 8*b*, 8*d*) and is fastened to the cover (4, 4*b*, 4*d*) when the container is mounted and ready for operation.

6. The dosing device according to claim 1, characterized in that the dispensing container (8, 8*b*, 8*d*) has for mounting at a bottom side or an upper side of the cover (4, 4*b*, 4*d*) fastening means for rapid mounting and demounting, the fastening means comprising adhesive tapes, gripping tapes and/or magnetic contacts fixed in such a way that the dispensing container can be fastened thereon by simple pressing.

7. The dosing device according to claim 1, characterized in that the dispensing container (8) has at least one bulge (12, 12*a*) with the aid of which it can be fixed at the cover (4, 4*a*) without a possibility of slip, the bulge (12, 12*a*) being so shaped that it penetrates an opening (6, 6*a*) delimited on all sides or a recess open toward the front side in the cover (4, 4*a*).

8. The dosing device according to claim 7, characterized in that the bulge (12, 12*a*) comprises at least one zone having a diameter larger than that of the opening or recess (6, 6*a*) of cover (4, 4*a*), the bulge (12, 12*a*) when mounted and ready for operation being clamped or engaged into the opening or recess (6, 6*a*) of the cover (4, 4*a*).

9. The dosing device according to claim 7, characterized in that the dispensing container (8, 8*b*, 8*d*) is shaped for fastening beneath the cover (4, 4*b*, 4*d*) and that at least one part of a region of the bulge (12, 12*d*) that is accessible from outside the cover (4, 4*b*, 4*d*) is made of material elastic to compression or bending, or of creasable material.

10. The dosing device according to claim 9, characterized in that the bulge has an external thread and is open toward an outside at an end, and that the region that is accessible from outside and elastic to compression or bending or can be creased is formed as a fixed or interchangeable component, of a bayonet union or a screw connection.

11. The dosing device according to claim 1, characterized in that it is made in the shape of the cover (4*e*) and that the device comprises a dispensing container (8*e*) which consists at least in part of a material that is elastic to compression or bending or can be creased.

12. Use of a dosing device according to claim 1 for pump-free delivery of a desired amount of a flowable medium onto a wiping aid.

13. Use according to claim 12 for body care, body therapy or domestic hygiene where the medium consists of a cleaning and/or care emulsion.

14. Use according to claim 12 for cleaning, polishing and/or lubricating of surfaces where the medium contains cleaning, polishing and/or lubricating agents.

15. The dosing device according to claim 1, which is suitable for dosing a non sprayable medium.

16. The dosing device according to claim 1, which can be fastened interchangeably at a withdrawal device for wiping aids.

17. The dosing device according to claim 1, wherein the wiping aids are selected from the group consisting of sheets of paper, paper towels, woven or non-woven fabric, cotton balls, and cotton pads.

18. The dosing device according to claim 3, wherein the diameter of the at least one delivery hole is adjustable in an infinite fashion.

19. The dosing device according to claim 4, wherein the dispensing container is provided with fastening means for rapid mounting and demounting without tools and comprises lateral projections and/or recesses which, when the device is mounted and ready for operation, enter and/or engage in recesses and/or projections, at two lateral flaps (4*b*') of the cover 4*b*, of essentially complementary shape.

20. The dosing device according to claim 6, wherein the dispensing container is provided with fastening means for rapid mounting and demounting without tools.

21. The dosing device according to claim 8, wherein the bulge is detachably clamped or engaged into the opening or recess of the cover.

22. The dosing device according to claim 10, wherein the zone that is accessible from outside is formed as an elastic membrane.

23. The dosing device according to claim 10, wherein the dispensing container is wedge-shaped.

24. Use according to claim 12, wherein the medium is selected from the group consisting of a creamlike or gellike emulsion.

25. Use according to claim 12, wherein the wiping aid is selected from the group consisting of sheets of paper, paper towels, woven or non-woven fabric, cotton balls, and cotton pads.

26. Use according to claim 14, for cleaning, polishing and/or lubricating of smooth surfaces of metal, plastic, wood or glass.

* * * * *